US006674224B2

(12) United States Patent
Garrity, Jr. et al.

(10) Patent No.: US 6,674,224 B2
(45) Date of Patent: Jan. 6, 2004

(54) TENSION FOCUS MASK FOR A CATHODE-RAY TUBE (CRT)

(75) Inventors: Edward Richard Garrity, Jr., Lancaster, PA (US); Kevin Duane Close, Landisville, PA (US); Steven Anthony Colbert, Lancaster, PA (US); Richard LaPeruta, Jr., Lititz, PA (US); David Paul Ciampa, Lancaster, PA (US); Samuel Paul Benigni, Lititz, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 154 days.

(21) Appl. No.: 09/800,234

(22) Filed: Mar. 6, 2001

(65) Prior Publication Data

US 2002/0125810 A1 Sep. 12, 2002

(51) Int. Cl.[7] ..... H01J 29/80

(52) U.S. Cl. ..... 313/402; 313/407; 313/408; 313/477 R

(58) Field of Search ..... 313/402, 403, 313/407–409, 412, 414, 404–406, 413

(56) References Cited

U.S. PATENT DOCUMENTS 2,971,117 A * 2/1961 Law ..... 315/13.1
3,668,002 A * 6/1972 Okabe et al. ..... 427/124
4,131,822 A * 12/1978 Branton ..... 313/403
4,188,562 A * 2/1980 Van Oostrum ..... 313/402
4,197,482 A * 4/1980 Koorneef et al. ..... 313/403
5,396,145 A * 3/1995 Shiohara et al. ..... 313/402
5,646,478 A * 7/1997 Nosker et al. ..... 313/402
6,320,304 B1 * 11/2001 Mikita et al. ..... 313/402

* cited by examiner

*Primary Examiner*—Nimeshkumar D. Patel
*Assistant Examiner*—German Colón
(74) *Attorney, Agent, or Firm*—Joseph S. Tripoli; Carlos M. Herrera; Patricia A. Verlangieri

(57) ABSTRACT

A color cathode-ray tube (CRT) having an evacuated envelope with an electron gun therein for generating at least one electron beam is disclosed. The envelope further includes a faceplate panel having a luminescent screen with phosphor lines on an interior surface thereof. A tension focus mask, having a plurality of spaced-apart first electrodes, is located adjacent to an effective picture area of the screen. The plurality of spaced-apart first electrodes has a screen-facing side having a predetermined width and a relatively wider electron-gun-facing side. Each side forming sharp corner edges extending along the length of each first electrodes. A substantially continuous insulating material is deposited on the screen-facing side and on the corners of the first electrodes to shield the sharp corner edges of the first electrodes. A plurality of second electrodes are oriented substantially perpendicular to the plurality of first electrodes and are bonded thereto by the insulating material layer.

4 Claims, 3 Drawing Sheets

TENSION FOCUS MASK FOR A CATHODE-RAY TUBE (CRT)

This invention relates to a cathode-ray tube (CRT) and, more particularly to a color CRT including a tension focus mask.

BACKGROUND OF THE INVENTION

A color cathode-ray tube (CRT) typically includes an electron gun, an aperture mask-frame assembly, and a screen. The aperture mask-frame assembly is interposed between the electron gun and the screen. The screen is located on an inner surface of a faceplate of the CRT tube. The screen has an array of three different color-emitting phosphors (e.g., green, blue and red) formed thereon. The aperture mask functions to collimate the electron beams generated in the electron gun toward appropriate color-emitting phosphors on the screen of the CRT.

The aperture mask may be a focus mask. Focus masks typically comprise two sets of electrodes that are arranged orthogonal to each other, to form an array of openings. Different voltages are applied to the two sets of electrodes so as to create quadrupole focusing lenses in each opening of the mask, which are used to direct and focus the electron beams toward the appropriate color-emitting phosphors on the screen of the CRT tube.

One type of focus mask is a tension focus mask, wherein at least one of the sets of electrodes is under tension. Typically, for tension focus masks, the vertical electrodes are held in tension by the mask frame. The other set of electrodes is horizontal and overlays the vertical electrodes, which are typically strands. An etching process used on a flat sheet of metal commonly forms the strands. Such an etching process forms sharp corner edges along the length of the strands.

The two sets of electrodes overlap at a series of points known as junctions. At these junctions the individual elements of one set of electrodes are separated from the individual elements of the other set by an insulating material. When the different voltages are applied between the two sets of strands of the mask, to create the quadrupole focusing lenses in the openings thereof, surface flashover may occur at one or more of the junctions. Surface flashover is a breakdown process that may take place on or near the surface of the insulating material separating the two sets of strands and may lead to arcing between the strands at one or more places on the focus mask. Since the overlying wires are electrically connected to one another, all of the energy stored in the capacitance of the entire focus mask is available to arc. This stored energy may be sufficient to cause local melting of the strands and/or the insulating material and may result in an electrical short leading to the subsequent failure of the focus mask. Surface flashover has a greater risk of occurring in locations in which one of the electrodes has a sharp edge, since the local electric field can be higher at these locations.

Additionally, during operation of the CRT tube, electron scattering may occur along sharp edges of the mask strands. Electron scattering along strand edges of the focus mask is undesirable because some of these electrons may strike the wrong color element, degrading the color purity of the CRT tube.

Thus, a need exists for suitable tension focus masks that overcome the above-mentioned drawbacks.

SUMMARY OF THE INVENTION

The present invention relates to a color cathode-ray tube (CRT) having an evacuated envelope with an electron gun therein for generating at least one electron beam. The envelope further includes a faceplate panel having a luminescent screen with phosphor lines on an interior surface thereof. A tension focus mask, having a plurality of spaced-apart first conductive electrodes, is located generally parallel to an effective picture area of the screen. The plurality of spaced-apart first conductive electrodes, otherwise known as strands, have a screen-facing side and electron-gun facing side. Each side of the strands have sharp corner edges extending along the length of the strands. A plurality of second conductive electrodes are oriented substantially perpendicular to the plurality of strands and separated by an insulating material deposited on the screen-facing side and corners of the strands to shield the sharp edges of the strands from the second conductive electrodes. In doing so, the present invention reduces the risk of surface flashover that would occur when sharp corners are formed using prior art etching processes.

BRIEF DESCRIPTION OF THE DRAWINGS

The invention will now be described in greater detail, with relation to the accompanying drawings, in which.

DETAILED DESCRIPTION

Figure 1:
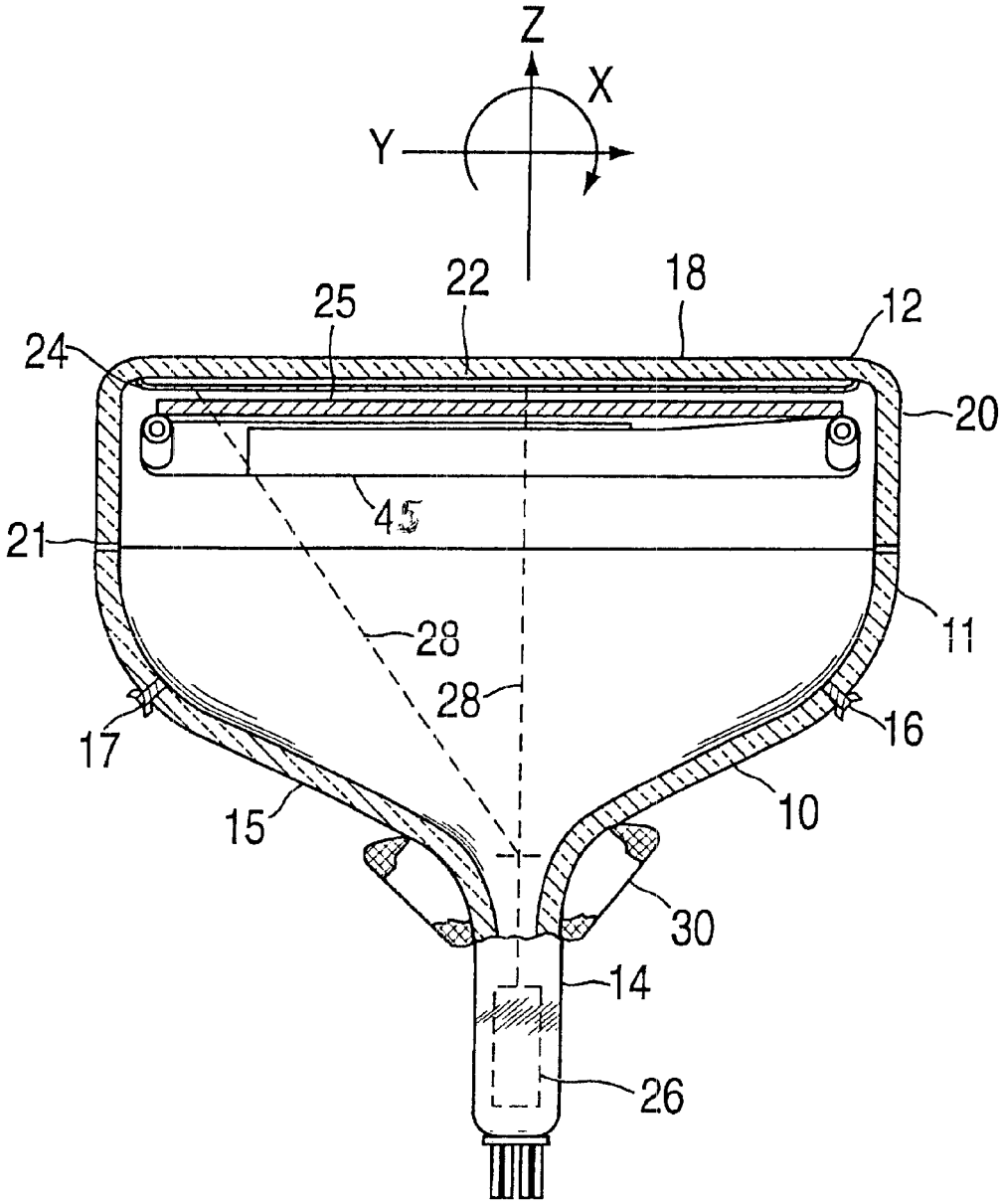
FIG. 1 is a plan view, partly in axial section, of a color cathode-ray tube (CRT) including a uniaxial tension focus mask-frame assembly embodying the present invention.

FIG. 1 shows a color cathode-ray tube (CRT) 10 having a glass envelope 11 comprising a faceplate panel 12 and a tubular neck 14 connected by a funnel 15. The funnel 15 has an internal conductive coating (not shown) that is in contact with, and extends from, a first anode button 16 to the neck 14. A second anode button 17, located opposite the first anode button 16, is contacted by a second conductive coating (not shown).

The faceplate panel 12 comprises a viewing faceplate 18 and a peripheral flange or sidewall 20 that is sealed to the funnel 15 by a glass fort 21. A three-color luminescent phosphor screen 22 is carried by the inner surface of the viewing faceplate 18. The screen 22 is a line screen (not shown) that includes a multiplicity of screen elements comprised of red-emitting, green-emitting, and blue-emitting phosphor lines respectively, arranged in triads, each triad including a phosphor line of each of the three colors. Preferably, a light-absorbing matrix (not shown) separates the phosphor lines. A thin conductive layer (not shown), preferably formed of aluminum, overlies the screen 22 and provides a means for applying a uniform first anode potential to the screen 22 as well as for reflecting light, emitted from the phosphor elements, through the viewing faceplate 18.

A multi-apertured color selection electrode, or uniaxial tension focus mask 25, is removably mounted, by conventional means, within the faceplate panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the uniaxial tension focus mask 25 to the screen 22. The inline direction of the center of the beams 28 is approximately normal to the plane of the paper.

The CRT of FIG. 1 is designed to be used with an external magnetic deflection yoke, such as the yoke 30, shown in the neighborhood of the funnel-neck junction. When activated, the yoke 30 subjects the three electron beams 28 to magnetic fields that cause the beams to scan a horizontal and vertical rectangular raster across the screen 22.

Figure 2:
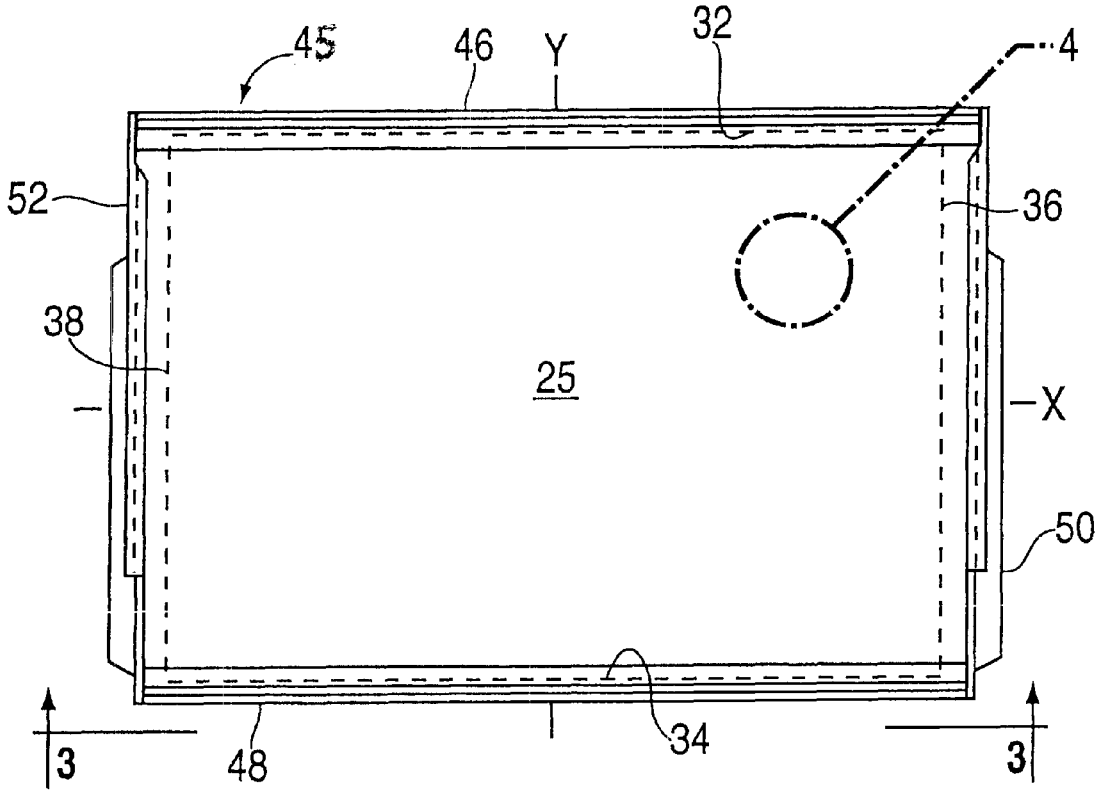
FIG. 2 is a plan view of the uniaxial tension focus mask-frame assembly of FIG. 1.
Figure 3:
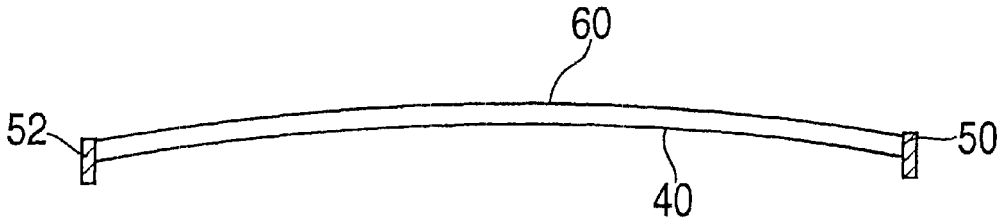
FIG. 3 is a side view of the mask frame-assembly taken along line 3—3 of FIG. 2.
Figure 4:
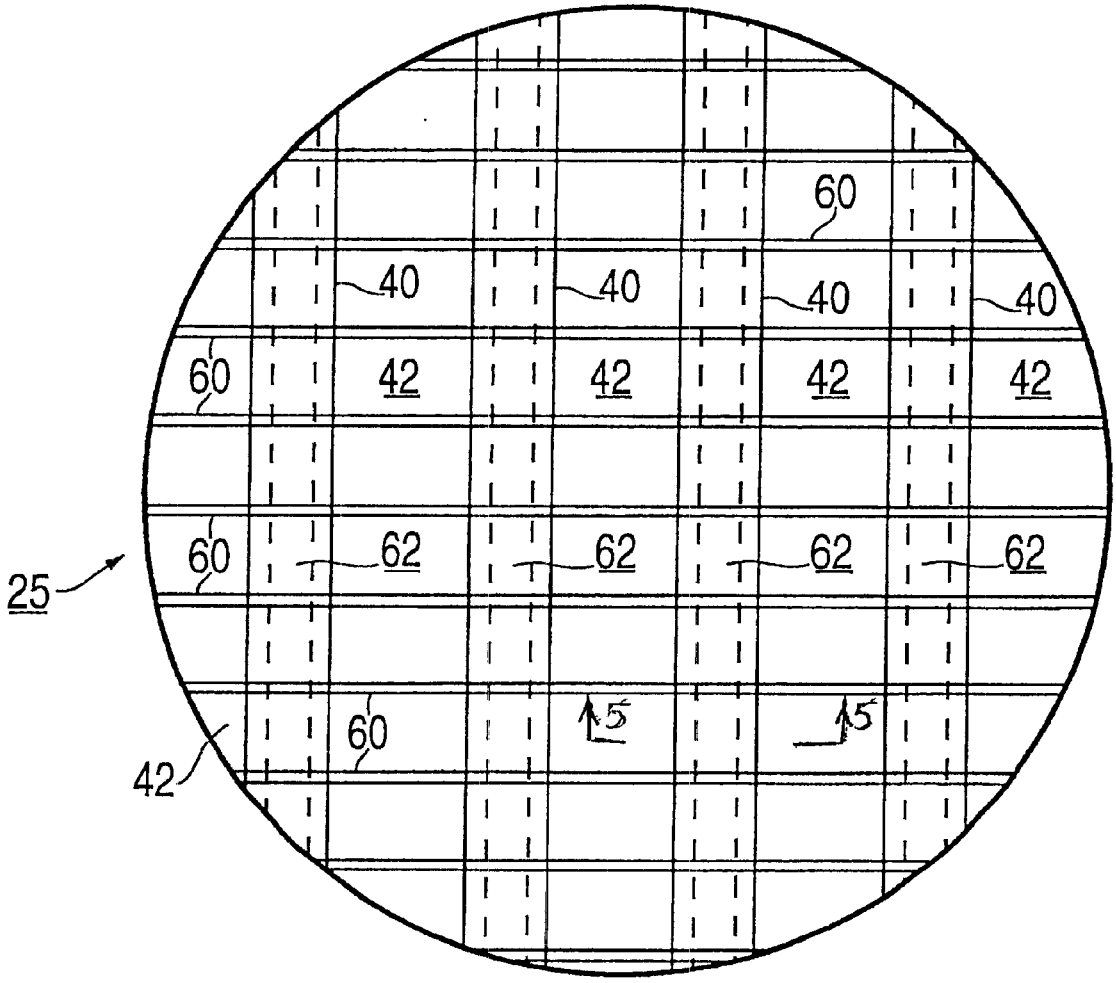
FIG. 4 is an enlarged section of the uniaxial tension focus mask shown within the circle 4 of FIG. 2.

As shown in FIG. 2, the uniaxial tension focus mask 25 (shown schematically by the dashed lines in FIG. 2) includes two horizontal sides 32, 34 and two vertical sides 36, 38. The two horizontal sides 32, 34 of the uniaxial tension focus mask 25 are parallel with the central major axis, X, of the CRT while the two vertical sides 36, 38 are parallel with the central minor axis, Y, of the CRT. A frame 45, for the tension focus mask 25, includes four major members, two horizontal members 46, 48 to which the horizontal sides 32, 34 of the tension focus mask 25 are attached and two vertical members 50, 52 to which the second metal electrodes 60 are attached. Members 46, 48 are substantially parallel to the major axis, X, and each other. The curvature of members 46, 48 may be shaped to substantially match the specific curvature of the CRT screen (see FIG. 3). The horizontal sides 32, 34 of the uniaxial tension focus mask 25 are welded to the two members 46, 48, which provide the necessary tension to the mask. The uniaxial tension focus mask 25 includes an apertured portion that overlies an effective picture area of the screen 22. Referring to FIG. 4, which is an enlarged section of the uniaxial tension focus mask shown within the circle 4 of FIG. 2, the uniaxial tension focus mask 25 includes a plurality of first metal electrodes, or conductive strands 40, separated by spaced slots 42 that parallel the minor axis, Y, of the CRT and the phosphor lines of the screen 22. In the preferred embodiment slots 42 each have a width within a range of about 0.1 mm to about 0.5 mm (4–20 mils)? For a color CRT having a diagonal dimension of 68 cm, the strands 40 have widths in a range of about 0.2 mm to about 0.5 mm (8–20 mils) and slot 42 widths of about 0.2 mm to about 0.5 mm (8–20 mils). In a color CRT having a diagonal dimension of 68 cm (27 V), there are about 800 strands 40. Each of the slots 42 extends from one horizontal side 32 of the mask to the other horizontal side 34 thereof (shown in FIG. 3).

Figure 5:
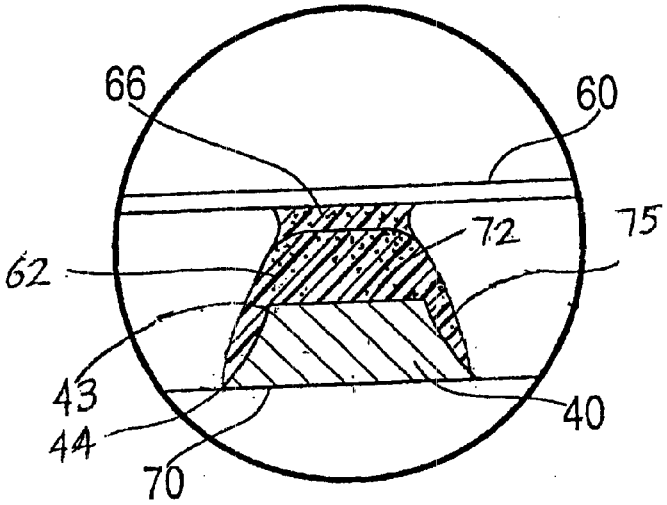
FIG. 5 is an enlarged view of a portion of the uniaxial tension focus mask taken along lines 5—5 of FIG. 4.

FIG. 5 is an enlarged view of a portion of the uniaxial tension focus mask along lines 5—5 of FIG. 4. Strands 40, depicted in FIG. 5, are formed by an etching process performed on a flat metal plate. The etching process involves a sequence of operations suitable to form slots 42. With the etching, new regions of the strands 40 are exposed. The preferred outcome is illustrated in FIG. 5 as strand 40 having a generally rectangular cross-section defined by screen-facing side 72, electron-gun facing side 70 and side walls 75. The etched strands 40 have associated with them a pair of relatively sharp edges at corners 43 and 44 being the top and bottom sharp edge portions shown in the embodiment of FIG. 5. As shown in FIG. 5, the edge of comers 43 at the intersection of the screen-facing side 72 and side walls 75 form corners with a relatively less sharp edge than the edges formed at corners 44. The shaper edges formed at corners 44 are positioned as far as possible from the cross-wires 60 to reduce the probability of surface flashover or arcing between the electrodes at one or more junctions. The arcing may be sufficient to cause local melting of the electrodes, destruction of the insulator, or both and may result in electrical short, leading to the subsequent failure of the focus mask. Further, the corners 43 closest to the cross-wires 60 is typically coated with an adhesive insulating material 62, reducing triple-point electron emission from this region and thereby also reducing the incidence of surface flashover.

According to the preferred embodiment, the strands 40 each have a transverse dimension, or width, of about 0.1 mm to about 0.5 mm (4–20 mils) for both the screen-facing side 72 and the electron-gun-facing side 70, with the screen-facing side 72 having a width about 0.025 to about 0.05 mm (1–4 mils) smaller than the width of the electron-gun-facing side 70. Although the strands 40 may be inverted so that the wider side of the strands 40 is closest to the second conductive electrodes 60, the above prescribed dimension of the strands 40 allows for less scatter of the electron beam 28, thereby providing a measurable improvement in the color purity of the CRT. For example, in a conventional color CRT, the red x-coordinate is about 0.633. The red x-coordinate measured for a tension focus mask 25 incorporating the geometry described above, and shown in FIG. 5, is about 0.627, as compared with 0.613 for tension focus masks 25, where the screen-facing side surface 72 is wider than the electron-gun-facing side 70. A further advantage in having a narrower electron-gun-facing side 70 immediately adjacent the second conductive electrodes 60 is that the adhesive material 62 may be applied to the screen-facing side 72 and allowed to accumulate along the side walls 75 to corners 44 so as to shield the corners of the strands 40 thereby reducing the potential for surface flashover.

With reference to FIGS. 4 and 5, a plurality of second conductive electrodes 60, each having a diameter of about 0.025 mm (1 mil), are disposed substantially perpendicular to the strands 40 and are bonded to the adhesive material 62 to electrically isolate the second conductive electrodes 60 from the strands 40. The vertical spacing, or pitch, between adjacent second conductive electrodes 60 is about 0.33 mm (13 mils) for a color CRT 10 having a diagonal dimension of 68 cm (27 V). The uniaxial tension focus mask 25, described herein, provides a mask transmission, at the center of the screen, of about 40–45%, and requires that the second anode, or focusing voltage, $\delta V$, applied to the second metal electrodes 60, differs from the first anode voltage applied to the strands 40 by less than about 1 kV, for a first anode voltage of about 30 kV. The combination of the strands 40 and the second conductive electrodes 60 along with the different electric potentials applied thereto function to create the quadrupole fields, which converge the electron beams 28 onto the color-emitting phosphors on the screen 22 of the CRT 10.

Although a single application of the insulative adhesive material 62 may be applied to the strands 40, FIG. 5 illustrates the result of a multiple process for applying the adhesive material 62. Such process includes applying a first coating of the insulative adhesive material 62, e.g., by spraying, onto the screen-facing side 72 of the strands 40. The strands 40, in this example, are formed of either creep resistant steel or a low expansion alloy, such as INVAR™. The strands 40 each have a transverse dimension, or width, such that the screen-facing side 72 maintains a width about 0.025 to about 0.05 mm (1–4 mils) smaller than the width of the electron gun facing side 70. The first coating of the insulative adhesive material 62 typically has a thickness of about 0.05 mm to about 0.1 mm (2–4 mils).

After the first coating of the insulative adhesive material 62 is hardened, a second coating of the insulative adhesive material 66 is applied over the first coating of the insulative adhesive material 62. The second coating of the insulative adhesive material 66 may optionally have a different composition from that of the first coating. The second coating of the insulative adhesive material 66 typically has a thickness of about 0.0025 mm to about 0.05 mm (0.1 to 2 mils).

Thereafter, the second metal electrodes 60 are applied to the frame 45, over the second coating of the insulative adhesive material 66, such that the second metal electrodes 60 are substantially perpendicular to the strands 40. The second metal electrodes 60 are applied using a winding fixture (not shown) that accurately maintains a desired spacing of, for example, about 0.33 mm (13 mils) between adjacent metal electrodes for a color CRT 10 having a diagonal dimension of about 68 cm (27 V).

The assembly is heated to a temperature of about 460° C. for about 30 minutes to cure the second coating of the insulative adhesive material 66, thereby bonding the cross-wires to the second coating of the insulative adhesive material 66. Following curing, electrical connections are made to the strands 40 and second metal electrodes 60, and the tension focus mask 25 is inserted into a tube envelope.

What is claimed is:

1. A cathode-ray tube comprising an evacuated envelope having therein an electron gun for generating at least one electron beam, a faceplate panel having a luminescent screen with phosphor lines on an interior surface thereof, and a tension focus mask, wherein the tension focus mask includes a plurality of elongated spaced-apart first electrodes which are substantially parallel to each other, and a plurality of spaced-apart second electrodes oriented substantially perpendicular to the plurality of spaced-apart first electrodes, said plurality of spaced-apart first electrodes comprising:

a screen-facing side, an electron-gun-facing side, and first and second side walls extending from said screen-facing side, said sides forming a substantially flat configuration with corner edges formed along said sides; and, an insulating material applied on said screen-facing side and said corner edges to bond said first electrodes to said second electrodes and to shield said edges of said first electrodes, wherein said insulating material covers said screen-facing side and said two side walls.

2. The cathode-ray tube of claim 1 wherein said screen-facing side and said electron-gun-facing side each have a predetermined width, wherein the width of said screen-facing side is smaller than the width of said electron-gun-facing side.

3. A cathode-ray tube comprising an evacuated envelope having therein an electron gun for generating at least one electron beam, a faceplate panel having a luminescent screen with phosphor lines on an interior surface thereof, and a tension mask oriented between the electron gun and the screen, said tension mask comprising:

a plurality of elongated spaced-apart strands which are substantially parallel to each other and extending substantially the entire length of said screen, said strands having a cross-section shape having a screen-facing side and a relatively larger electron-gun-facing side, each of said sides spaced-apart by side walls wherein said side walls and sides form corners having edges extending along the length of said strands;

a plurality of spaced-apart electrodes oriented substantially perpendicular to the strands and defining a specific space between a surface thereof and said screen-facing side; and, a first insulating material layer disposed in said space and along said corners to shield said edges from said electrodes, wherein said insulating material layer covers said screen-facing side and said side walls.

4. The cathode-ray tube of claim 3 further comprising a second insulating material disposed on said first insulating material within said space to contact said spaced-apart electrodes.

* * * * *